United States Patent [19]

England

[11] Patent Number: 4,646,100

[45] Date of Patent: Feb. 24, 1987

[54] LATCH ASSEMBLY FOR PHASED ARRAY RADAR ANTENNA

[75] Inventor: Forrest E. England, Arnold, Md.

[73] Assignee: Westinghouse Electric Corp., Pittsburgh, Pa.

[21] Appl. No.: 727,964

[22] Filed: Apr. 26, 1985

[51] Int. Cl.[4] ..... H01Q 1/02; H01Q 1/12

[52] U.S. Cl. ..... 343/757; 343/882; 74/816

[58] Field of Search ..... 343/757, 763, 880, 882; 74/816, 817

[56] References Cited

U.S. PATENT DOCUMENTS

| | | | |
|---|---|---|---|
| 390,190 | 9/1888 | Richards | 74/813 L |
| 3,908,484 | 9/1975 | Degen | 74/813 R |
| 4,050,337 | 9/1977 | Allemand | 74/813 L |
| 4,109,552 | 8/1978 | Imoberdorf | 74/813 L |

*Primary Examiner*—Eli Lieberman

*Attorney, Agent, or Firm*—W. G. Sutcliff

[57] ABSTRACT

An improved latch assembly which operates with a phased array radar antenna to fixedly retain the radar antenna in any one of several predetermined positions. The latch assembly comprises an elongated body member having a leading end section tapered to interfit into the detent means without jamming, a wedging member having a tapered wedge-like configuration which slidably interfits with the gradually tapered ledge of the body member, and a controllable spring-loaded actuating means operable to move the elongated body member and the wedge member into locking engagement with a predetermined detent and then to move the wedging member an additional small distance toward the predetermined detent, this causes the wedging member to be forced laterally an amount sufficient to contact the sides of the housing to effect a controlled wedging of the latch assembly in the housing to prevent any rotation of the radar antenna because of undesired clearances between the elongated body member and the housing.

7 Claims, 14 Drawing Figures

LATCH ASSEMBLY FOR PHASED ARRAY RADAR ANTENNA

GOVERNMENT CONTRACT

This device was developed under U.S. Government Contract No. F33657-81-C-0212.

BACKGROUND OF THE INVENTION

1. Field of the Invention

The present invention relates to an improved latch assembly which operates with a phased array radar antenna to fixedly retain the radar antenna in any one of several predetermined positions.

2. Description of the Prior Art

The phased array radar antenna will usually be located in the nose cone of an aircraft. Its special requirements make it unique among conventional radar antennas. Unlike conventional radar which physically, continuously sweeps the horizon in a 180° arc, the phased array radar antenna is inset with phase control modules. These modules electronically scan the horizon while the antenna remains fixed. The phased array radar antennas primary positioning requirement is that it must remain in a locked, stable, fixed position for the duration of its electronic scan.

A phased array radar antenna utilizes a latch pin to hold it in any one of several desired positions, typically three. The latch assembly is designed to provide a spring load on the pin which compensates for tolerances of the detent ring and assembly of the latch onto the antenna. The end of the pin preferably utilizes a Morse taper which provides the most shallow taper which will not then be jammed in place due to friction forces. The taper also assures that the fit between the pin and rotating parts will be tight and not allow relative motion.

A problem arises when the fixed phased array radar antenna is disturbed, thereby loading the end of the pin and creating minimal clearances between the detent pin and the latch pin housing. Thus a minimal clearance allows the detent latch pin to move which in turn allows the antenna to move. By design, approximately ¼ milliradian of antenna motion is allowed without seriously affecting antenna performance. Part wear, lack of tolerance between the parts, however, cannot allow this built-in clearance to become larger. In practice, one antenna had been measured with up to 1 milliradian of free motion.

A further problem, and perhaps a more serious one, is the effect of the latch pin clearance on the dynamics of the antenna. In phase array radar antenna, for example, the radio frequency performance places an important requirement that the antenna be as rigid as possible so that the resonant frequency of the antenna structure can be as high as possible. Any free motion in the structural system results in degradation of the antenna dynamics and, in turn, of the antenna RF performance.

The problem to be solved, therefore, is the problem of reducing the clearance between the pin housing essentially to zero without degrading the performance of the latch itself. It would be desirable to minimize any modifications to the latch assembly once in place and the antenna is in production. The preferred embodiment of the disclosed invention, the improved latch assembly, accomplishes both desired effects.

To resolve this problem of zero housing and latch pin clearance, several approaches may be taken. One approach is to machine the pin and housing to extremely tight tolerances. This would increase the cost and technical risks, however, without ever achieving zero clearance. Another approach would be to place a heater upon the pin, causing the pin to expand due to thermal expansion. The problem with the thermal expansion technique, however, is that a sufficient time must pass after heating for the pin to cool before it can be successfully retracted.

SUMMARY OF THE INVENTION

The present invention is directed to an improved latch assembly which operates with a phased array radar antenna to fixedly retain the radar antenna in any one of several predetermined positions. A rotatable ring member affixed to the radar antenna coupled with a plurality of detent means in the outer surface of the ring operate in cooperation with a latch assembly to retain the ring and, therefore, the antenna in any one of these three predetermined positions.

The latch assembly comprises three distinct integrated members: a latch pin member having a leading end section conformed to interfit to any of the selected detent means provided in the antenna ring structure; a housing means in which the latch pin member slides interfitting to restrain the latch pin against appreciable rotation; and a controlled spring-actuated means for moving the latch pin member into a detent interacting position to lock the antenna against rotation. The latch assembly is also capable of moving the same latch pin away from the detent contact position to free the antenna for rotation.

The present latch assembly includes an elongated body member having a lead-in section tapered to interfit into the detent means without jamming, and side portions dimensioned to freely slide interfittingly with respect to the housing member. The trailing end portion of the elongated body member is further adapted to receive and retain the connector portion of the actuating means. The elongated body member is recessed to form a ledge which gradually tapers from a location intermediate the ends of the body member. This ledge interfits with a wedging member having a wedge-like configuration which interfits with the body member. The trailing end portion of the wedge member is also adapted to receive and retain the connector portion of the actuating means, thereby allowing it to reciprocate during its functioning with the body member. Finally, the controlled spring-loaded means which actuates the latch detent pin operates to move the body member into locking engagement with the predetermined detent and to move the wedge member an additional distance toward the detent. This movement causes the wedge member to move laterally an amount sufficient so that the improved latch pin contacts both sides of the housing member. This contact produces a controlled wedging so that the combined latch assembly and the housing will not permit motion of the antenna. Whatever clearance existed between the elongated body member and the housing, has been successfully removed.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

The improved combination detent latch pin evolved from the prior designed detent pin because a phased array radar antenna must remain motionless during electronic scanning operations. Due to machining tolerances, the prior art detent could not provide the required motion free performance.

Figure 1:
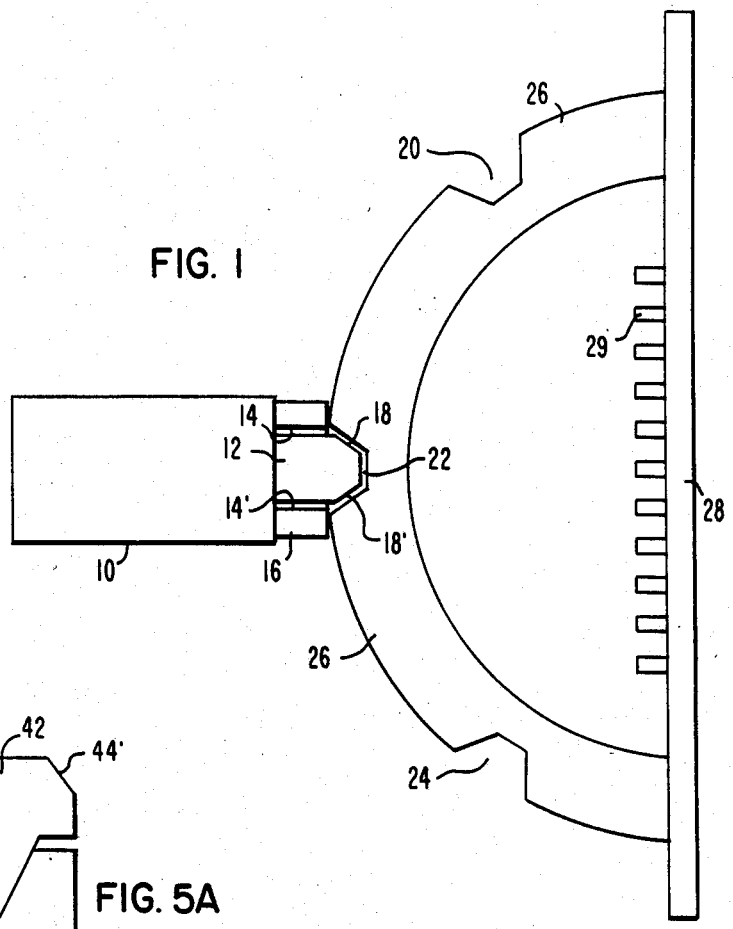
FIG. 1 is a schematic representation of the initial design latch pin detent system.

FIG. 1 a schematic of the prior design detent pin system consists of a spring-loaded latch pin actuating means 10 working in conjunction with a solid detent pin 12. During actuation of the prior design detent pin 12 the pin moves slidingly forward within the walls 14, 14' of the detent pin housing 16 until the tapered edges 18, 18' on the leading end of the detent pin 12 interacts with the detent spaces 20, 22, 24 located in any one of the three preselected positions on the detent ring 26. The prior design detent system in its actuated position retained the detent ring 26 and the attached phased array radar antenna 28 relatively motion free during the electronic scanning operations of the antenna 28, by the array pattern of electronically controlled phase variable beam forming modules 29. In actual performance however, machining tolerances cannot reasonably maintain a perfect fit between the prior design detent pin 12 and the interior walls 14, 14' of the detent pin housing 16. Consequently, the detent pin 12 will experience slight movement during antenna operation between the leading edges 18, 18' of the prior design detent pin 12 and any one of the preselected detents 20, 22, 24 within the detent ring 26.

Figure 2:
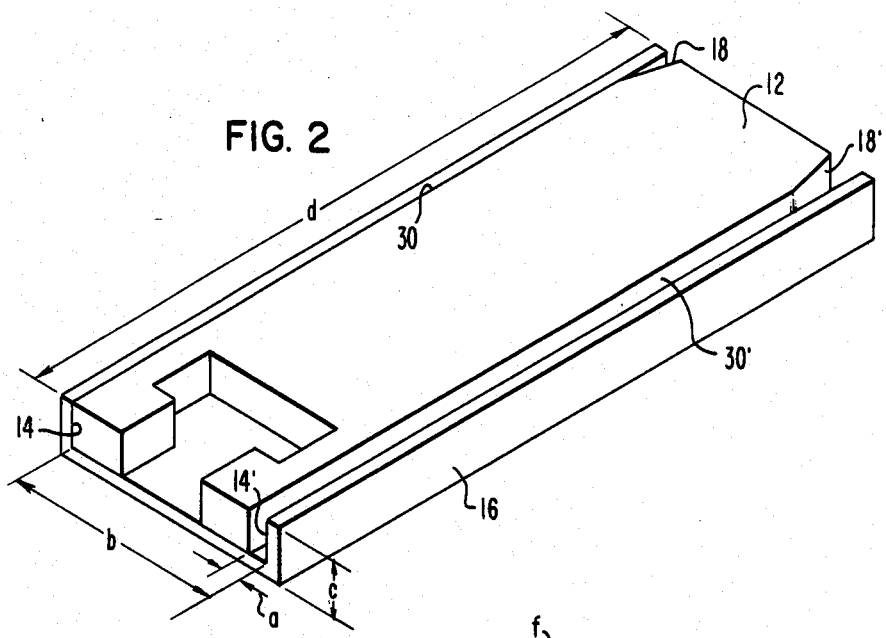
FIG. 2 is an isometric view of the initial design detent pin and housing.

FIG. 2 demonstrates the clearance problems possible when the detent pins 12 exterior edges 30, 30' do not slidingly interfit precisely with the interior walls 14, 14' of the detent pin housing 16. Critical tolerances which occur in the use of the prior design detent pin 12 are as small as, 0.003 to 0.0012 inch (0.076 to 0.03 mm), as seen in dimension "a". Dimension "a" is the free space between the exterior lateral edge 30' of the prior art detent pin 12 and the interior wall 14' of the detent pin housing 16. The overall available lateral space between the interior walls 14, 14' of the detent pin housing 16 is shown by dimension "b" 0.7487±0.0004 inch (1.9017±0.0010 cm). The overall height of the detent pin housing 16 is dimension "c" 0.1858±0.003 inch (4.72±0.076 mm) and the overall length of the detent pin housing 16, is dimension "d" 2.282±0.003 inch (5.80±0.0076 mm).

Figure 3:
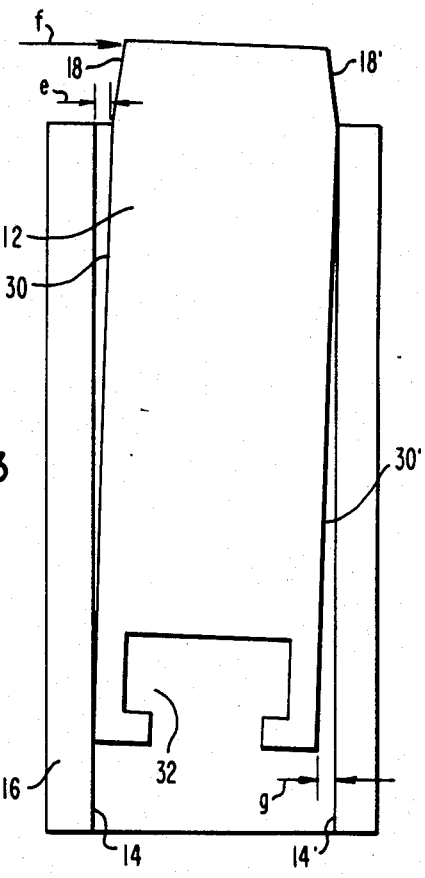
FIG. 3 is a planar representation of the initial design detent pin and housing demonstrating the forces as they occurred in actual application.

FIG. 3 demonstrates the effect of a lateral force "f", applied to the prior design detent pin 12. Such a force "f" would occur if loading forces were applied to the phased array radar antenna 28. A loading force "f", is applied to the leading end of the prior design detent pin 12. This force "f" causes the pin 12 to move laterally within the detent pin housing 16. The leading end portion of the pin, edges 18, 18' will move in the direction of the force "f" while the slotted, actuating interface end 32 of the prior design detent pin 12 will move in the opposite direction to the leading edge end 18, 18'. This resultant tilting or repositioning of the prior design detent pin 12, within the detent pin housing 16 creates two acres, dimension "e" and "g". These areas, dimensions "e" and "g" will create a pin 12 instability which will result in a shifting of the detent ring 26 and ultimately the phased array radar antenna 28.

Figure 4:
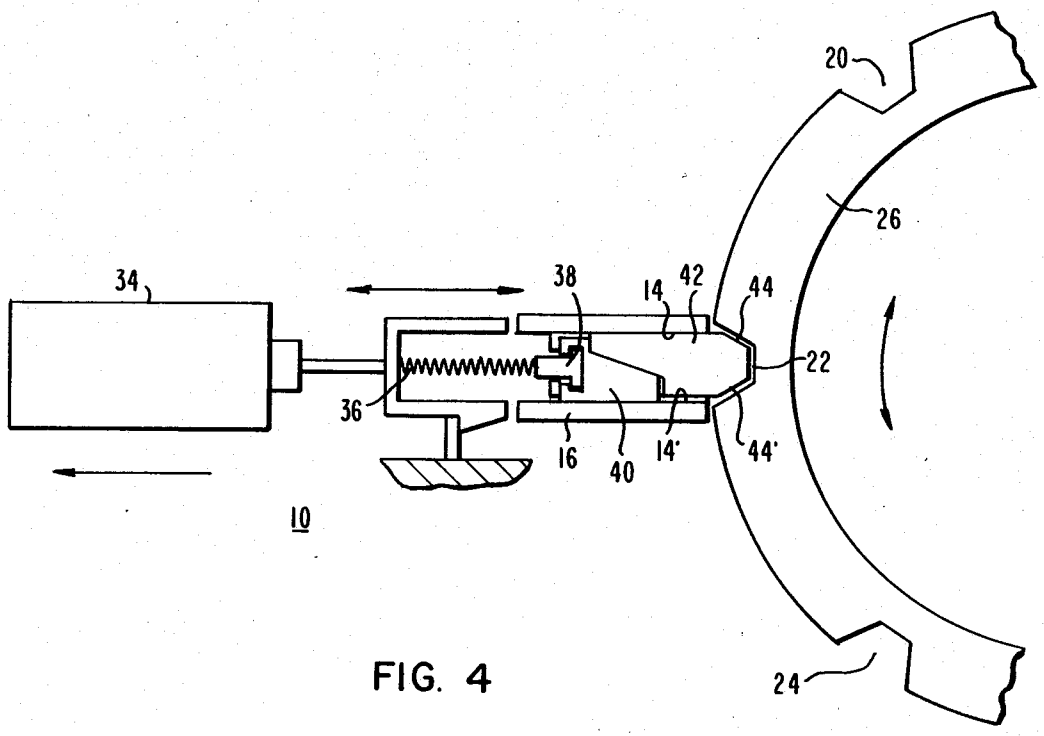
FIG. 4 is a graphic representation of the preferred embodiment of the present invention as it is to be utilized in the detent latch pin system.

The preferred embodiment of the present invention as shown in FIG. 4 utilizes the same spring-actuated latch pin means 10 as the prior design detent pin 12. The solenoid 34 activates the spring means 36 which then moves the connector 38 forward or backward. Specifically, the connector 38 pushes or withdraws the wedge portion 40 of the improved detent latch pin 40, 42. The wedge portion 40, which slidably interfits the elongated body portion 42 of the improved detent pin, is now used in conjunction with the prior art spring-loaded activation means 10 to secure the detent ring 26 and subsequently the phased array radar antenna 28 in any one of three detent positions 20, 22, 24. The walls 14, 14' of the detent housing 16 which slidably accommodate the improved wedge 40 and elongated body member 42 during activation will now hold the improved detent latch pin 40, 42 rigid in any one of the three preselected detent positions 20, 22, 24 of the detent ring 26.

Figure 5A:
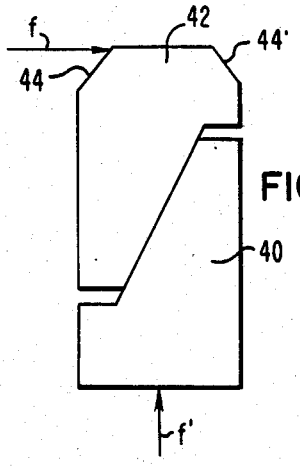
FIG. 5A is a planar representation of the present improved detent pin demonstrating forces as they occur in actual application.
Figure 5C:
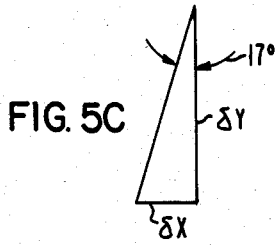
FIG. 5C is a diagram of the preferred angles of the wedge member of the present detent pin.
Figure 5B:
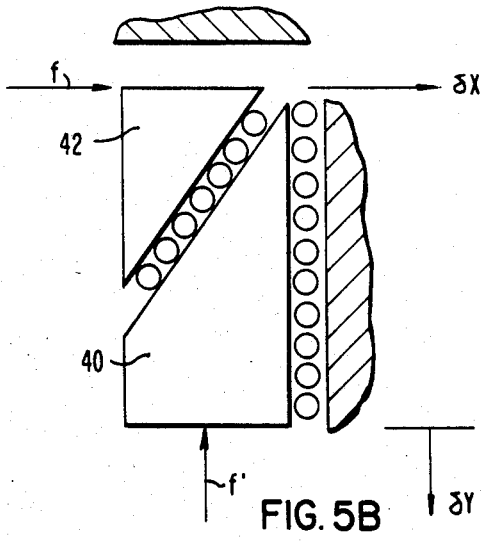
FIG. 5B is a force diagram of the forces exerted in the present improved detent pin.

FIGS. 5A, 5B and 5C demonstrate that the load required to move the elongated body member 42 of the improved detent latch pin 40, 42 and the wedge member 40 can be calculated using standard work calculations.

If the virtual displacement of $\delta X$ for each lateral force "f", results in the virtual displacement of $\delta Y$ for each spring force, "f'", and the virtual work performed can be calculated as:

$$f \cdot \delta X = f' \cdot \delta Y.$$

With a wedge member 40 having a slope of 17° from the vertical requiring:

$$\delta X / \delta Y = \tan 17°$$

$$f = f' / \tan 17°$$

$$\geqq 42.5 \text{ lbs. } (19.3 \text{ Kg.})$$

to move the latch pin, where "f," the spring force is a force of 13.0 lbs. (5.90 Kg.).

If a design imbalance limit of 24.0 in-lb for each 1.0 g exists, and we require the lateral acceleration of the wedge member 40 during detent pin 40, 42 actuation; we can solve for N, the number of g's required to move the wedge.

$$N = \frac{d_{cr} \cdot f}{I_L}$$

where:

N=Number of g's required to move the wedge $d_{cr}$=Distance, from the center of rotation, to the point where the pin engages the detent ring f=Force required to move the latch pin $I_L$=Design imbalance limit For this example $$d_{cr} = 4.0 \text{ in.}$$

$$f = 42.5 \text{ lbs}, I_L = 24.0 \text{ in-lb.}$$

$$\therefore N = \frac{(4.0 \text{ in.})(42.5 \text{ lbs.})}{(24.0 \text{ in.-lb.})}$$

$$N = 7.1 \text{ g's}$$

This calculation demonstrates that it would take a lateral acceleration of 7 g's to move the wedge member.

Figure 6B:
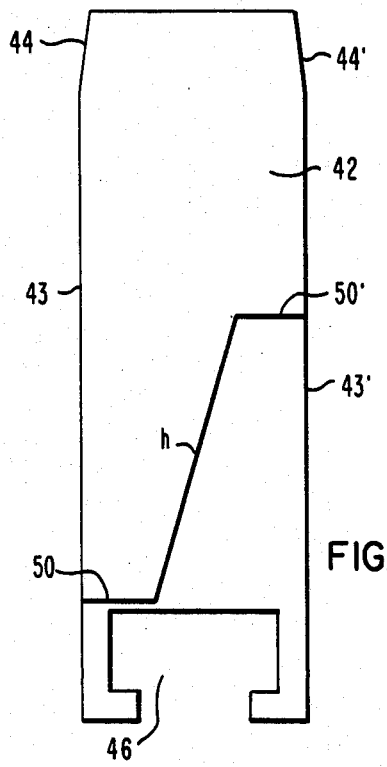
FIG. 6B is a plan view of the elongated body member of the present detent latch pin.
Figure 6A:
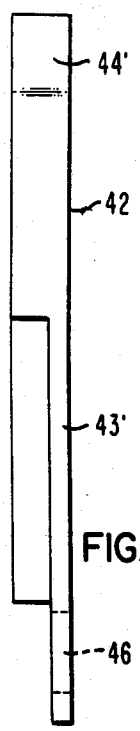
FIG. 6A is a side view of the elongated body member of the present detent latch pin.

FIG. 6A is a side view of the preferred embodiment, the elongated body member 42. FIG. 6B is the plan view of the elongated body member 42, comprising a metal structure having exterior edges 43, 43' and leading end portions edges 44, 44'. Elongated body member 42 will be able to engage various detents 20, 22, 24 in the detent ring 26. This actuation will occur when the slotted, trailing end portion 46 of the elongated body member 42 is contacted by the wedge portion 40. The wedge portion 40 slidingly interfits the elongated body member 42 along the angle of the tapered truncated right triangle, dimension "h". The angle of the taper per inch could be 0.3000±0.0020 inch (0.076±0.0051 mm); wherein, the leading edges of the truncated right triangle, edges 50, 50' would arrest the forward movement of wedge member 40.

Figure 7A:
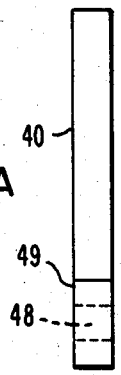
FIG. 7A is a side view of the wedge member of the present pin.
Figure 7B:
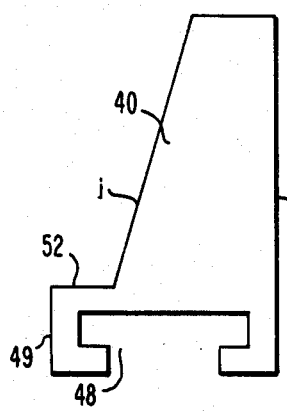
FIG. 7B is a plan view of the present wedge member.
Figure 7C:
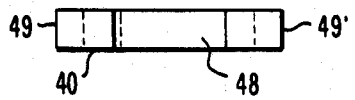
FIG. 7C is an end view of the same wedge member.

FIG. 7A is a side view of the wedge member 40. FIG. 7B, a front plan view of the wedge member 40 comprising a truncated right triangle, with a trailing slotted end portion 48, exterior edges 49, 49', and leading edges 52, 52'. The angle of the tapered truncated right triangle, is dimension "i". The angle of this taper, "i" per inch could be, for example 0.2940±0.0020 inch (0.1157±0.0051 mm.). Wherein, the leading edges 52, 52' of the wedge portion 40 and taper "i", would slidingly interfit taper "h" of the elongated body member 42 and leading edges 50, 50' of the elongated body portion 42.

Figure 8A:
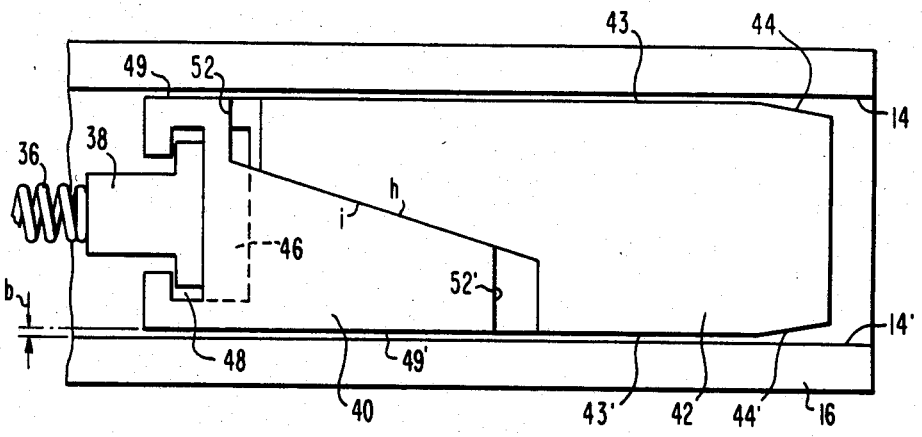
FIG. 8A is a plan view of the preferred embodiment of the elongated body member as it will interact with the wedge member, but in the unactuated position.

FIG. 8A demonstrates the preferred embodiment of the present invention in the unactuated position. The wedge member 40 and the elongated body member 42 rest within the walls 14, 14' of the detent housing 16. Clearance dimension "b" represents the space between the exterior edges 43, 43' of the elongated body member 42 and the interior walls of the detent housing 16. In FIG. 8A, spring 36 is not yet activated by the solenoid 34. Connector 38 rests within the slotted, trailing end portion 46 of the elongated body member 42 and the slotted, trailing end portion 48 of wedge member 40. The dimension of the slotted trailing end portion 46, which is axially disposed with respect to the elongated body member 42 is of a greater corresponding dimension than the slotted trailing end portion 48 of wedge member 40. As a specific example, the axial dimension of the slotted trailing end portion 46 of the elongated body portion 42 is approximately twice the corresponding dimension of the slotted trailing end portion 48 of the wedge member 40. The wedge portion 40 and the elongated body portion 42 so rest within the detent pin housing 16 such that their exterior edges 43, 43' and 49, 49', respectively, are parallel. Also, the leading edge of the truncated right triangle interface 52, 52' of the wedge portion 40 is parallel to the truncated right triangle interface 50, 50' of the elongated body member 42. The tapers dimensions "h" and "i" of the elongated body member 42 and wedge portion 40 also, rest parallel to each other. The leading edges 44, 44' of the elongated body member are retracted within the detent pin housing 16.

Figure 8B:
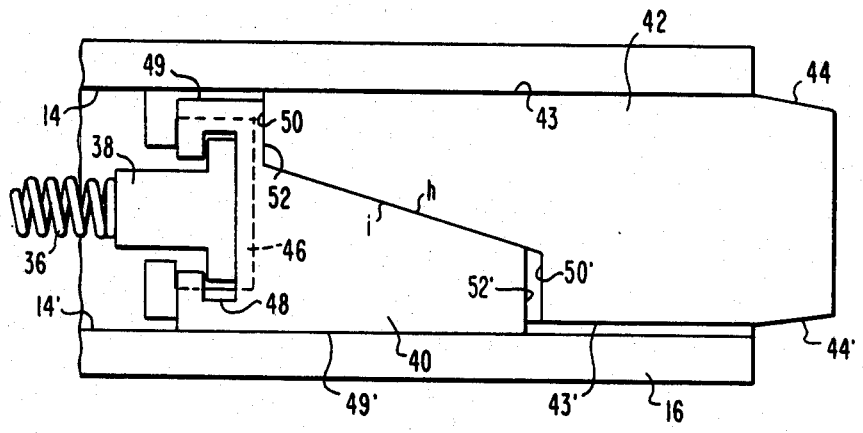
FIG. 8B is a plan view of the preferred embodiment of the detent latch pin combination in the wedging or actuated position.

FIG. 8B demonstrates the improved latch pin in the locked position. The spring-loaded actuating member 10 comprising the solenoid 34 spring 36 and connector 38 move the wedge portion 40 toward the detent 20, 22, 24 in the detent ring 26. The wedge portion 40 moves a small distance toward the detent 20, 22, 24 when the connector 38 contacts the slotted, trailing end portion 48 of the wedge member 40. The wedge portion 40 continues to move toward the detent 20, 22, 24 while the taper dimension "i" of the wedge portion 40 slidably interfits the taper dimension "h" of the elongated body member 42. When the tapered section "i" contacts tapered section "h", both members 40, 42 slidingly move within the detent pin housing 16 toward any one of three detents 20, 22, 24. The spring-loaded latch pin actuating means 10 continues to move both the wedge member 40 and elongated body member 42 toward the selected detents until the exterior edge 43 of the elongated body member 42 contacts the interior wall 14 of the detent housing, and the exterior edge 49' of the wedge portion 40 contacts the interior wall 14' of the detent housing 16. When this contact occurs the leading edges 44, 44' of the elongated body portion 42 are moved toward detent ring 26 to interfit into any one of three detents 20, 22, 24 of the detent pin ring 26 rigidly fixing the phased array radar antenna 28 into any one of three positions. In the actuated position, the exterior edge 49 of the wedge member 40 will have some clearance from the interior wall 14 of the detent pin housing 16. The exterior edge 43' of the elongated body member 42 will experience a clearance between the interior wall 14' of the detent pin housing 16. In actual application, the parallel distances between the truncated right triangle interfaces 50, 50' of the elongated body member 42 and the truncated right triangle interfaces 52, 52' of the wedge portion 40 will diminish during actuation of the improved composite detent pin.

When the detent system is to be disengaged to permit the movement of the phased array radar antenna 28 to another fixed selected position, the spring loaded latch pin actuating means 10 will move away from the engaged detent 20, 22, 24. The solenoid 34 will withdraw the spring 36 which will withdraw the connector 38 which rests within the slotted trailing end portion 48 of the wedge member 40. The connector 38 will upon withdrawal away from the detent 20, 22, 24 eventually contact the slotted trailing end portion 46 of the elongated body member 42. This contact between the connector 38 and the slotted trailing end portion will result in the withdrawal of the elongated body portion 42 from the detent 20, 22, 24.

We claim:

1. An improved latch assembly which operates with a positionable radar antenna to fixedly retain said radar antenna in any one of several predetermined positions, a positionable ring member affixed to said radar antenna, a plurality of detent means provided in the outer surface of said ring member and operable to cooperate with said latch assembly to fixedly retain said ring member and thus said antenna in any one of said predetermined positions, said latch assembly comprising a latch pin member having a leading end section conformed to interfit into any of said detent means provided in said ring member, housing means in which said latch pin member slidably interfits to restrain said latch pin against appreciable rotation, and controllable spring-actuated means for moving said latch pin member into detent-contacting position to lock said antenna against rotation and also to move said latch pin member away from detent-contacting position to free said antenna for rotation, said improved latch assembly comprising:

an elongated body member having a leading end section tapered to interfit into said detent means without jamming, the side portions of said body member dimensioned to freely slidably interfit into said housing member, the trailing end portion of said body member adapted to receive and retain a connector portion of said actuating means to controllably reciprocate said elongated body member within said housing member both into and out of contact with a predetermined one of said detents, and a surface portion of said body member being recessed to form a ledge which gradually tapers from a location intermediate the ends of said elongated body member;

a wedging member having a tapered wedge-like configuration which slidably interfits with said gradually tapered ledge of said body member, the trailing end portion of said wedging member adapted to receive and retain said connector portion of said actuating means to cause said wedging member to be reciprocated with said body member; and said controllable spring-actuated means operable to move said wedging member laterally an amount sufficient to slidingly contact the sides of said housing member and then to move said elongated body member into locking engagement with a predetermined one of said detents to effect a controlled wedging of said latch assembly in said housing to prevent any rotation of said antenna because of clearances between said elongated body member and said housing, and said controllable spring-loaded actuating means also operable to be retracted to retract said controllable wedging member and to move said elongated body member away from said contacted detent to permit rotation of said ring member and said antenna.

2. The combination as specified in claim 1, wherein said leading end section of said elongated body member is conformed as a Morse taper.

3. The combination as specified in claim 1, wherein said leading end section of said wedge member is conformed as a Morse taper.

4. The combination as specified in claim 1, wherein said recessed portion of said body member is conformed as a truncated right triangle having a Morse taper, the base portion of said truncated right triangle extends partially across the width of said elongated body member and is located proximate said trailing end portion of said elongated body member, and said trailing end portion of said elongated body member also being recessed.

5. The combination as specified in claim 4, wherein said trailing end portion of said body member is generally conformed as an open slot to receive said connector portion of said actuating means, and said trailing portion of said wedging member is also conformed as an open slot having a dimension paralleling the axis of said wedging member which is a predetermined amount less than the corresponding dimension of said slot in said body member so that said wedging member can be moved by said actuating means to move said elongated body member into contact with a predetermined one of said detents.

6. The combination as specified in claim 1, wherein said radar antenna is adapted for use with a phase array radar antenna comprising a generally planar radiator driven by an array pattern of electronically controlled phase variable beam forming modules.

7. The combination as specified in claim 1, wherein said radar antenna requires the precision of locking of said radar antenna in each said predetermined position.

* * * * *